US006727880B2

(12) United States Patent
Lee

(10) Patent No.: US 6,727,880 B2
(45) Date of Patent: Apr. 27, 2004

(54) LIQUID CRYSTAL DISPLAY DEVICE HAVING A SOURCE DRIVER AND METHOD FOR DRIVING THE SAME

(75) Inventor: Duk-Min Lee, Ichon-shi (KR)

(73) Assignee: Hynix Semiconductor Inc., Ichon-shi (KR)

( * ) Notice: Subject to any disclaimer, the term of this patent is extended or adjusted under 35 U.S.C. 154(b) by 205 days.

(21) Appl. No.: 09/962,814

(22) Filed: Sep. 26, 2001

(65) Prior Publication Data

US 2003/0001814 A1 Jan. 2, 2003

(30) Foreign Application Priority Data

Jun. 30, 2001 (KR) ..... 2001-38691

(51) Int. Cl.[7] ..... G09G 3/36
(52) U.S. Cl. ..... 345/98; 345/100
(58) Field of Search ..... 345/92, 94, 95, 345/96, 97, 98, 104, 100

(56) References Cited

U.S. PATENT DOCUMENTS 4,564,915 A * 1/1986 Evans et al. ..... 345/550
6,496,130 B2 * 12/2002 Nagao ..... 341/144
6,538,630 B1 * 3/2003 Tanaka et al. ..... 345/94
2003/0034947 A1 * 2/2003 Tanaka et al. ..... 345/89

FOREIGN PATENT DOCUMENTS

JP 10-326084 12/1998 ..... G09G/3/20

* cited by examiner

*Primary Examiner*—Amare Mengistu
(74) *Attorney, Agent, or Firm*—Jacobson Holman PLLC

(57) ABSTRACT

A source driver of a liquid crystal display device and a method for driving the liquid crystal display device, which is capable of reducing power consumption therein. The source driver includes a register block for storing digital data signals associated with tone information; a level shifter for converting voltage levels of the digital data signals into predetermined voltage levels; an output buffer controller for generating buffer control signals in response to the digital data signals; a resistor string for establishing gradation voltages; an output buffer for transferring the gradation voltages in response to the buffer control signals; and a digital to analog converter for providing the gradation voltages transferred from the output buffer into a liquid crystal display panel in response to output signals supplied from the level shifter.

18 Claims, 4 Drawing Sheets

LIQUID CRYSTAL DISPLAY DEVICE HAVING A SOURCE DRIVER AND METHOD FOR DRIVING THE SAME

FIELD OF THE INVENTION

The present invention relates generally to a liquid crystal display (LCD) device and, more specifically, to a source driver capable of the reducing power consumption of a LCD device and a method for driving the LCD device with the source driver thereof.

BACKGROUND OF THE INVENTION

LCD devices have typically been used as display components in portable electronic apparatuses such as cellular phones and portable gaming devices. As power dissipated by a LCD device is most dominant in whole power consumption in a portable apparatus, battery life is shortened. The problem of insufficient battery power becomes more severe in a smaller sized portable apparatus, such as a miniature gaming device.

FIG. 1 shows a functional constitution of a known source driver employed in a LCD device, being associated with 240 channels. The source driver shown in FIG. 1 has a register block 100 storing digital data signals, a level shifter 200 converting voltage levels of the digital data signals supplied from the register block 100 into predetermined voltage levels, a digital-to-analog converter (DAC) 300 generating an alternative one of a plurality of gradation voltages V1~V64 in response to output signals from the level shifter 200, and an output buffer 400 transferring output signals of the DAC converter 300 to source lines arranged in a LCD panel.

The register block 100, which may be constructed in various architectures, includes a shift register 110, a sampling register 120, and a hold register 130. The shift register 110 generates enable signals E1~Em in sequence. The sampling register 120 receives and stores the digital data signals that are R/G/B data signals R0~R5, G0~G5, and B0~B5 in pixels, each of which is composed of three channels, in response to the enable signals E1~Em provided from the shift register 110. The hold register 130 receives and stores the R/G/B data signals held in the sampling register 120 in pixels thereof in a time and transfers them to the level shifter 200 in response to a load signal LD.

With respect to operation of the source driver shown in FIG. 1, the sampling register 120 stores predetermined data bits, e.g., the R/G/B data signals R0~R5, G0~G5, and B0~B5, in response to the plurality of enable signals E1~Em supplied from the shift register 110. For instance, when the first enable signal E1 is applied to the shift register 110, the sampling register 120 receives the first R/G/B signal and then simultaneously stores it into the first through third channels among plural channels. Consequently, the second R/G/B signal is simultaneously stored in the fourth through sixth channels among the plural channels in response to the second enable signal E2. Through the aforementioned procedures, all the R/G/B signals are settled in channels corresponding to pixels of the sampling register 120 in response to enable signals supplied from the shift register 110. The R/G/B signals held in channels of the sampling register 120 move into channels of pixels in the hold register 130 in response to the externally supplied load signal LD.

The R/G/B signals divisionally assigned to channels are transferred to the level shifter 200 so as to be converted to signals having predetermined voltage levels. The level shifter 200 converts voltage levels of the R/G/B signals into predetermined levels before providing them to the DAC 300 which is driven at a high voltage.

The R/G/B signals with the converted voltage levels set by the level shifter 200 are applied to the DAC 300. The DAC 300 selects an alternative one of the plurality of gradation voltages V1~V64 in accordance with the output signals from the level shifter 200 and then provides such voltage to the output buffer 400. The output buffer 400 applies analog signals generated from the DAC 300 to source lines arranged in the LCD panel (not shown).

In the construction of the source driver that is divided into the digital parts of registers and analog parts of the level shifters, the DAC and output buffer, the analog parts dissipate a large portion of the entire amount of power consumed by the source driver. In particular, most of the consumed power in the analog part is concentrated on the output buffer directly involved in a data output operation of the source driver. Current consumed by the buffer is classified as static current for a stand-by state, and operational current for normal activation. The current state that is dominant in the buffer is the static current because the operational current flows only for a very short time.

Considering current consumption properties in the buffer, the conventional manner for operating the source driver requires an increase in the number of buffers in proportion to the larger size and higher resolution of LCD panels desired by consumers, which magnifies the amount of power consumed. Furthermore, in the circumstance that LCD devices associated with the conventional source drivers are employed in miniaturized and portable electronic apparatuses such as cellular phones and gaming devices, problems are encountered when attempts are made to reduce power consumption, achieve a low power condition with batteries, or lengthen the operational life of batteries.

SUMMARY OF THE INVENTION

It is, therefore, an object of the present invention to provide a source driver capable of reducing power consumption in a LCD device and to provide a method for driving the LCD device.

It is another object of the present invention to provide a source driver capable of reducing power consumption during a stand-by state in a LCD device and to provide a method for driving the LCD device.

In order to attain the above objects, according to an aspect of the present invention, there is provided a source driver of a liquid crystal display device, the source driver including a register block for storing digital data signals associated with tone information; a level shifter for converting voltage levels of the digital data signals into predetermined voltage levels; an output buffer controller for generating a plurality of buffer control signals in response to the digital data signals; a resistor string for establishing a plurality of gradation voltages with analog constituent; an output buffer for transferring the gradation voltages in response to the buffer control signals; and a digital-to-analog converter for providing the gradation voltages transferred from the output buffer into a liquid crystal display panel in response to output signals supplied from the level shifter.

According to another aspect of the invention, a source driver of a liquid crystal display device includes a shift register for generating a plurality of enable signals in sequence; a sampling register for storing a plurality of R/G/B data signals at their corresponding pixels in response to the enable signals; a hold register for storing the R/G/B data signals supplied through the sampling register; a level shifter for converting voltage levels of the R/G/B data signals of the hold register into predetermined voltage levels; an output buffer controller for generating a plurality of buffer control signals in response to the R/G/B data signals; a resistor string for establishing a plurality of gradation voltages with analog constituent; an output buffer for transferring the gradation voltages in response to the buffer control signals; and a digital-to-analog converter for providing the gradation voltages transferred from the output buffer into a liquid crystal display panel in response to output signals supplied from the level shifter.

The invention also provides a method for driving a liquid crystal display device having a plurality of buffer units and a liquid crystal display panel, the method including steps of generating a digital data signal as tone information; level-shifting the digital data signal; comparing the digital data signal with an address signal assigned to one of the buffer units; loading an alternative one of gradation voltages into the buffer unit assigned to the alternative gradation voltage in accordance with a result of the comparison; and providing the alternative gradation voltage to the liquid crystal display panel in response to the level-shifted signal.

The present invention further includes a method for driving a liquid crystal display device having a plurality of buffer units and a liquid crystal display panel including steps of generating a plurality of enable signals in sequence; storing address signals to designate the buffer units; generating a plurality of gradation voltages; receiving external R/G/B data signals and storing the R/G/B data signals in their corresponding pixels in response to the enable signals; level-shifting voltage levels of the R/G/B data signals to predetermined voltage levels; generating control signals after comparing the R/G/B data signals with the address signals; generating a plurality of buffer control signals to operate the buffer units; loading an alternative one of gradation voltages into an conductive buffer unit assigned to the alternative gradation voltage; and providing the alternative gradation voltage to the liquid crystal display panel in response to the level-shifted signal.

The present invention will be better understood from the following detailed description of the exemplary embodiments thereof taken in conjunction with the accompanying drawings, with a scope thereof being pointed out in the appended claims.

BRIEF DESCRIPTION OF THE DRAWINGS

The present invention will be described by way of exemplary embodiments, but not limitations, illustrated in the accompanying drawings in which like references denote similar elements, and in which.

DESCRIPTION OF THE PREFERRED EMBODIMENT

The following detailed description is illustrative of the best mode presently contemplated by the inventors for practicing the invention. It should be understood that the description of these preferred embodiments should not be taken in a limiting sense.

Figure 2:
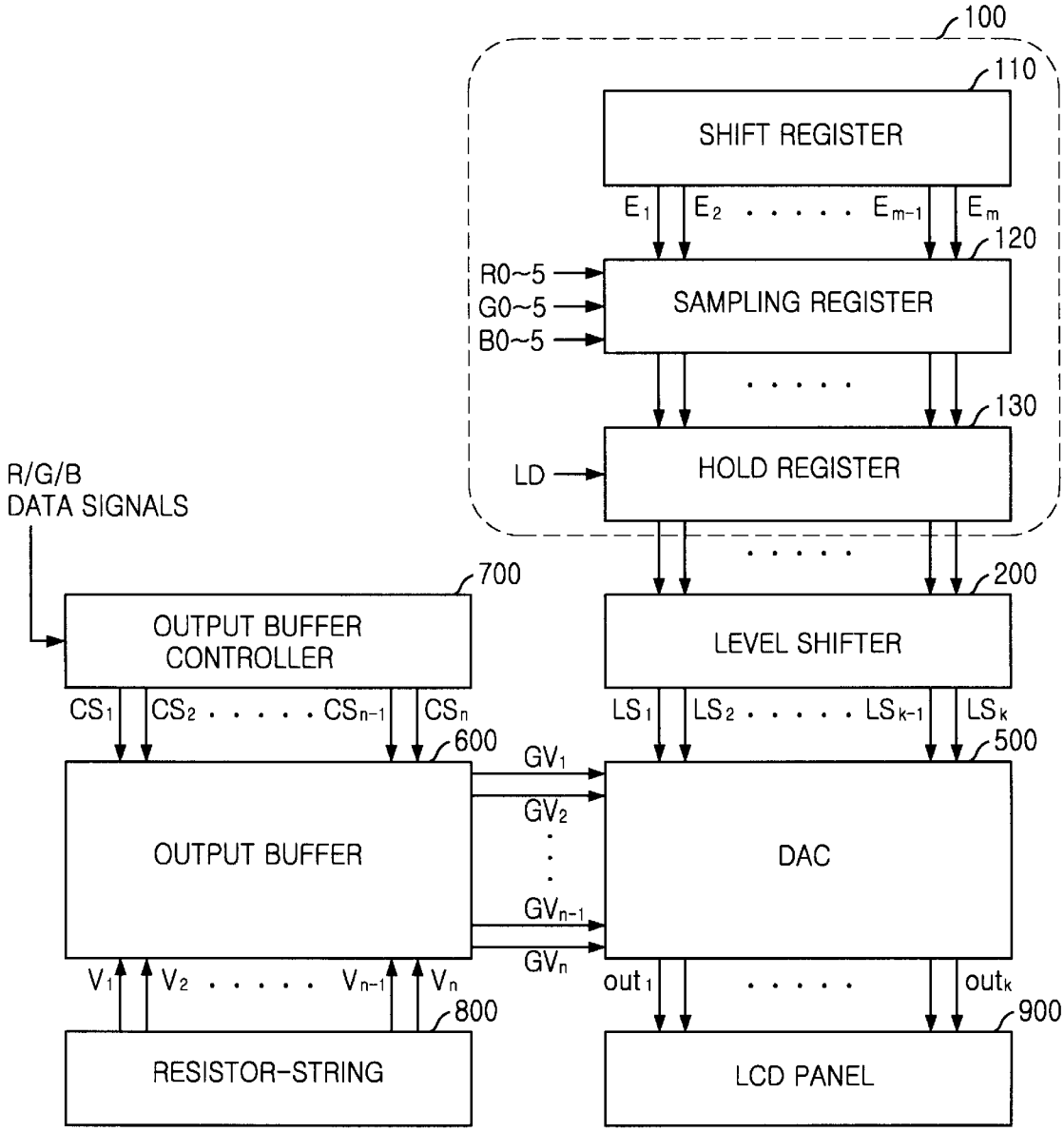
FIG. 2 is a functional block diagram of a source driver embedded in a LCD, according to a preferred embodiment of the present invention.

FIG. 2 shows the construction of a source driver according to an embodiment of the invention. Referring to FIG. 2, the inventive source driver includes a register block 100, a level shifter 200, an output buffer control circuit 700, a resistor string 800, an output buffer 600, and a DAC 500. The register block 100 stores digital data signals (hereinafter, referred to as R/G/B data signals). The level shifter 200 converts voltage levels of the R/G/B data signals into predetermined voltage levels. The output buffer control circuit 700 generates buffer control signals CS1~CS*n* in response to the R/G/B data signals. The resistor string 800 provides plural gradation voltages V1~Vn to the output buffer 600. The output buffer 600 receives and holds the gradation voltages V1~Vn and then generates output signals GV1~GVn to be applied to the DAC 500, in response to the holds control signals CS1~CS*n*. The DAC 500 provides analog output signals OUT1~OUTk converted from the output signals GV1~GVn in response to output signals LS1~LSk supplied from the level shifter 200.

Figure 1:
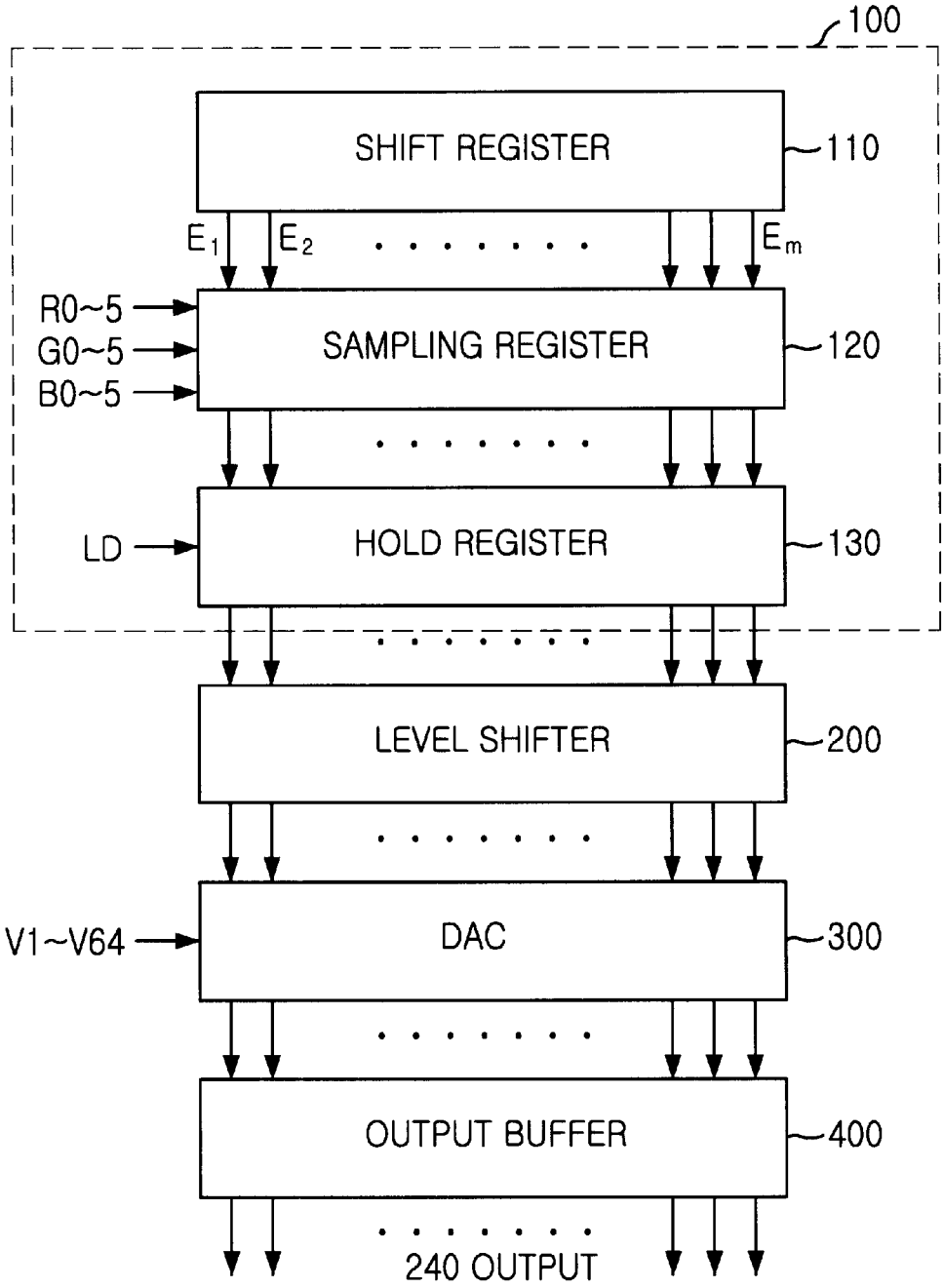
FIG. 1 (PRIOR ART)
FIG. 1 is a functional block diagram of a conventional source driver embedded in a LCD.

The register block 100, which is comparable with that shown in FIG. 1, includes a shift register 110, a sampling register 120, and a hold register 130. The shift register 110 generates enable signals E1~Em in sequence. The sampling register 120 receives and stores 18-bit video signals that are composed of respective 6-bit R/G/B data signals R0~R5, G0~G5, and B0~B5 in pixels each of which is composed of three channels, in response to the enable signals E1~Em provided from the shift register 110. The hold register 130 receives and stores the R/G/B data signals held in the sampling register 120 in pixels thereof in a time and transfers them to the level shifter 200 in response to a load signal LD.

Now an operational procedure of the source driver shown in FIG. 2 will be explained. The sampling register 120 stores the R/G/B data signals R0~R5, G0~G5, and B0~B5, in response to the enable signals E1~Em supplied from the shift register 110. As each pixel is composed of three channels, the first 6-bit R/G/B data signals are stored in the first through third channels in response to the first enable signal E1, and the second 6-bit R/G/B data signals are stored in the fourth through sixth channels in response to the second enable signal E2. Through the aforementioned procedures, all the R/G/B data signals are settled in channels corresponding to pixels of the sampling register 120 in response to the enable signals supplied from the shift register 110, the last 6-bit R/G/B data signals being stored in the last three channels.

Assuming that each scan line of a LCD device is composed of 80 pixels, the shift register 110 generates 80 enable signals of E1 through E80 and the sampling register 120 stores the R/G/B data signals provided in sequence by 6 bits in 240 (80×3=240) channels.

After completing the storage operation for the R/G/B data signals in a scan line by means of the sampling register 120, the hold register 130 stores the R/G/B data signals corresponding to a scan line therein at the same time in response to the externally-supplied load signal LD. The level shifter 200 converts the R/G/B data signals supplied from the hold register 130 into high voltage signals and then applies them to the DAC 500.

Meanwhile, the R/G/B data signals are also applied to the output buffer control circuit 700 which generates buffer control signals CS1~CS*n*.

The output buffer 600 includes a plurality of buffers which are conductive in accordance with the buffer control signals CS1~CS*n*, respectively. It is possible to arrange a number of buffers to match a number of gradation voltages, e.g., 64 buffers for 64 gradation voltages, in the embodiment of the invention, whereas the conventional number of buffers is dependent on the number of channels in a panel, e.g., 80 buffers for 80 channels. Thus, since the number of buffers arranged in the output buffer not only corresponds to the number of gradation voltages but is fewer than in the conventional arrangement, it is possible to reduce the amount of power consumed in the LCD device regardless of the increased number of channels that follows due to enlargement of the LCD panel.

The plurality of buffers in the output buffer 600 operate in accordance with the states of the buffer control signals CS1~CS*n*, respectively, and transfer their corresponding gradation voltages to the DAC. The gradation voltages provided through the buffers of the output buffer 600 are rendered to be the input signals GV1~GV*n* for the DAC 500. Assuming that the first gradation voltage V1 out of the 64 gradation voltages V1~V64 is to be applied into a panel, a buffer assigned to V1 is enabled and thereby provides the first gradation voltage V1 to the DAC 500 as an input GV1. At the same time, the other 63 buffers are conditioned in shut-off states by which there is no static current dissipated during a stand-by period.

The DAC 500 then receives GV1 from the output buffer 600, and applies an output signal corresponding to the GV1 to the LCD panel 900 in response to the output signals LS1~LS*k* supplied from the level shifter 200. The LCD panel 900 displays a pixel responding to the gradation voltage GV1.

Activating an alternative one among the buffers of the output buffer 600, corresponding to a current gradation voltage level, enables power consumption in the output buffer to be reduced. This reduction in power consumption is accelerated by the merits of the reduced number of buffers, such number being dependent on the number of the gradation voltage levels (e.g., 64 units for 64 levels) rather than the number of channels, as well as the shut-off states of the other buffers which were not selected.

Figure 3:
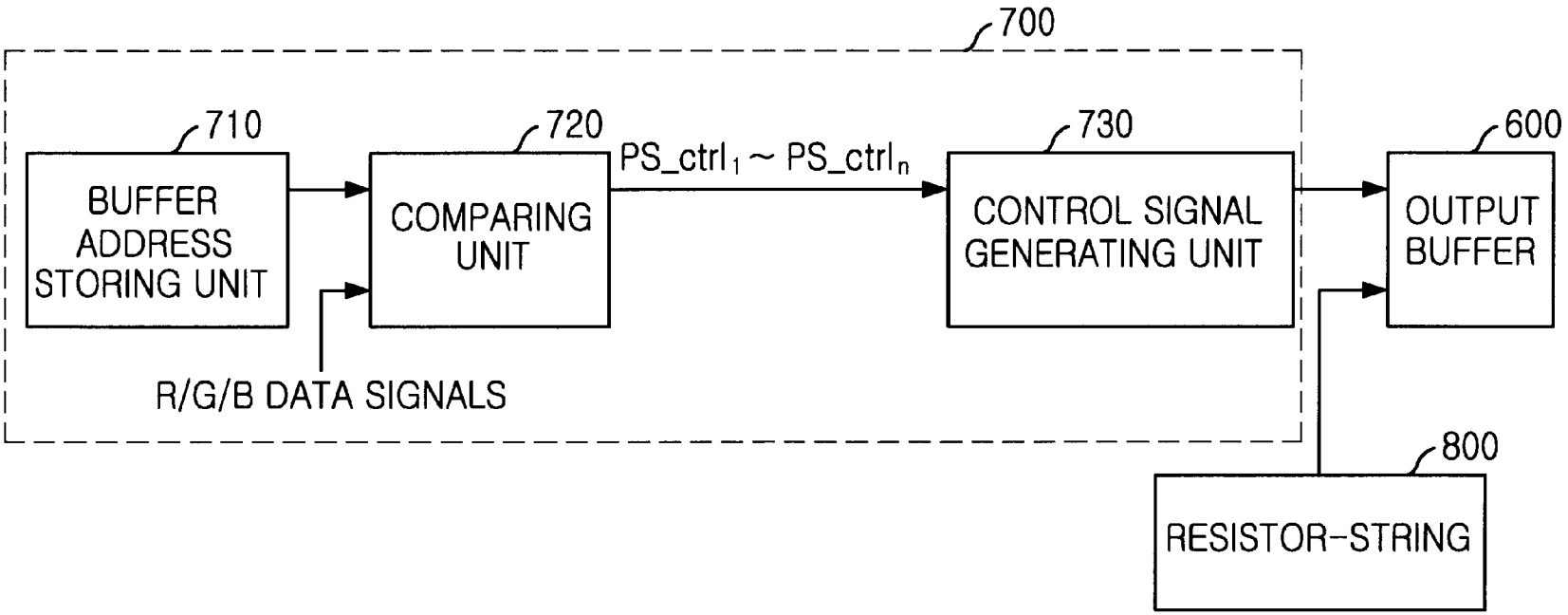
FIG. 3 is a functional block diagram of the output buffer controller shown in FIG. 2.
Figure 4:
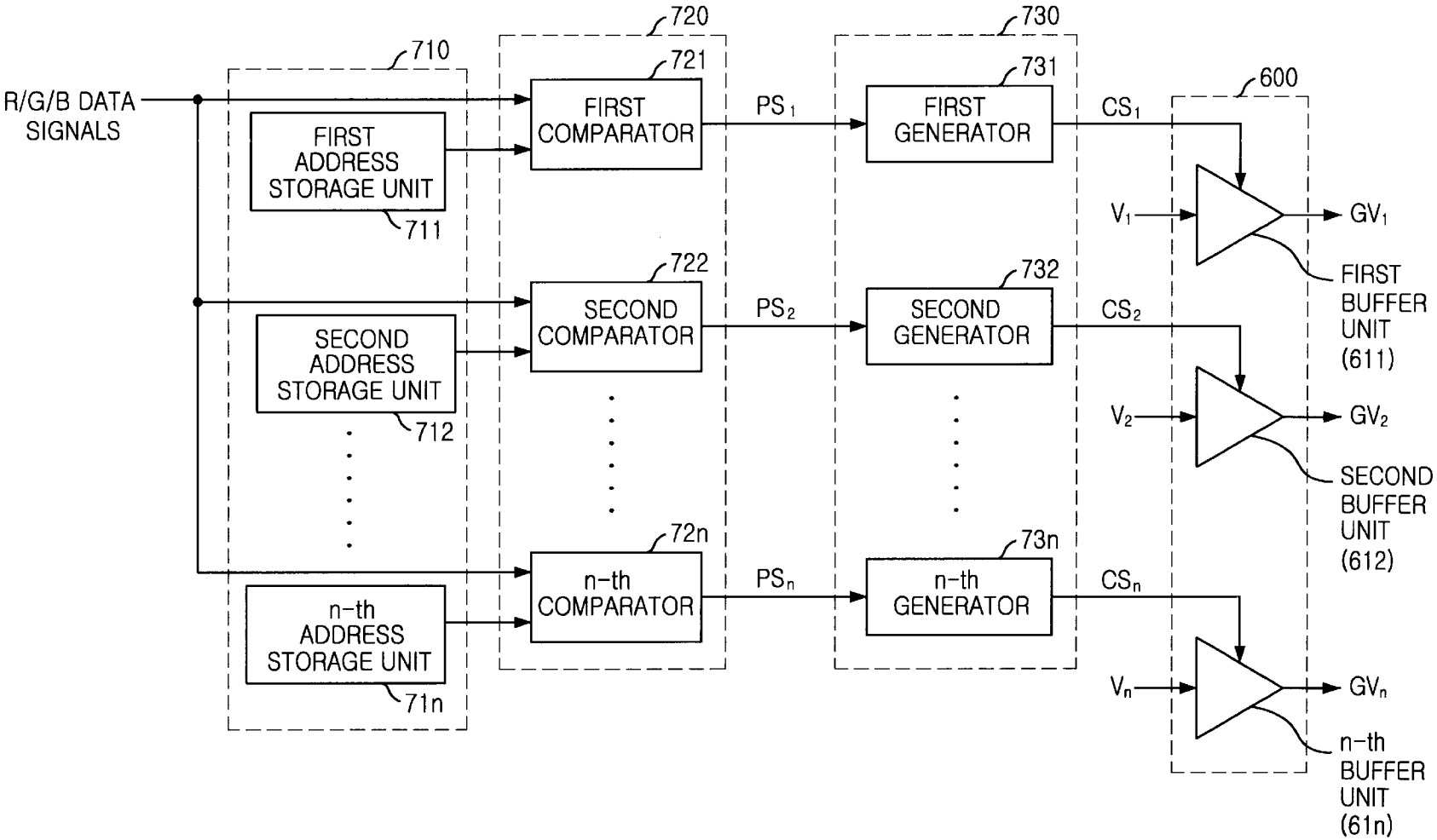
FIG. 4 is a detailed functional block diagram illustrating the internal architecture of the output buffer controller shown in FIG. 3.

FIG. 3 shows the functional construction within the output buffer control circuit 700, and FIG. 4 shows this construction in greater detail.

Referring to FIG. 3, the output buffer control circuit 700 is constructed of a buffer address storing unit 710 for storing addresses designating locations of the buffers in the output buffer 600, a comparing unit 720 for comparing output signals of the buffer address storing unit 710 with the R/G/B data signals, and a control signal generating unit 730 for creating the buffer control signals CS1~CS*n* in response to output signals PSctrl1~PSctrln supplied from the comparing unit 720.

The buffer address storing unit 710 is formed of first to n-th buffer address storage units 711~71*n* each of which has an address corresponding to one of buffers 611~61*n* in the output buffer 600. The addresses stored in the first to n-th buffer address storage units 711~71*n* of the block 710 designate the buffers 611~61*n* for transferring the gradation voltages assigned to predetermined tone information. For example, assuming that the first buffer 611, the second buffer 612, . . . , and the n-th buffer 61*n* transfer the first gradation voltage V1, the second gradation voltage V2, . . . , and the n-th gradation voltage Vn, respectively, the first address storage unit 711, the second address storage unit 712, . . . , and the n-th address storage unit 71*n* store addresses for the first buffer 611, the second buffer 612, . . . , and the n-th buffer 61*n*, respectively.

The comparing unit 720 is composed of a plurality of comparators 721~72*n* for generating control signals PSctrl1~PSctrln after comparing the output signals (i.e., buffer addresses) of the buffer address storage units with the R/G/B data signals. The control signals PSctrl1~PSctrln are enabled when the R/G/B data signals are identical to the output buffer address signals from the first to n-th buffer address storage units 711~71*n*.

The control signal generating unit 730 is constructed of first to n-th signal generators 731~73*n* creating the buffer control signals CS1~CS*n* in response to the control signals PSctrl1~PSctrln supplied from the comparators 721~72*n* in order to operate the buffers 611~61*n* of the output buffer 600.

While the comparing unit 720 is operable in the field of a digital power source voltage because the R/G/B data signals are designed to be established on the basis of the digital voltage, the output buffer 600 uses an analog power source voltage. Hence, it is desirable to provide level shifters (or level converters) in the first to n-th signal generators 731~73*n* in order to generate buffer control signals CS1~CS*n* adaptable to the analog voltage condition.

In operation of the output buffer control circuit 700, the buffer address storing unit 710 stores addresses for the buffers 611~61*n* in the units 711~71*n*, in which each of the first through n-th storage unit, 711~71*n*, store addresses for designating a respective one of the buffers 611~61*n*. The output signals from the units 711~71*n* are applied to the comparators 721~72*n* of the block 720, respectively. The comparators 721~72*n* also receive the R/G/B data signals in sequence.

The comparators 721~72*n* of the block 720 generate control signals PSctrl1~PSctrln resulting from comparing the buffer address signals with the R/G/B data signals. For instance, assuming that the output address signal from the storage unit 71*n* is identical to a 6-bit R/G/B data signal that has information about the n-th gradation, the n-th comparator 72*n* generates the control signal PSctrln.

The signal generators 731~73*n* of the block 730 generate the buffer control signals CS1~CS*n* in response to the control signals PSctrl1~PSctrln supplied from the comparators 721~72*n*, respectively. For example, the first signal generator 731 responds to the first control signal PSctrl1 to generate the first buffer control signal CS1 for operating the first buffer 611. The second signal generator 732 responds to the second control signal PSctrl2 to generate the second buffer control signal CS2 for operating the second buffer 612. In the same manner, the n-th signal generator 73*n* receives the n-th control signal PSctrln and then generates the n-th buffer control signal CSn for operating the n-th buffer 61*n*.

The output buffer 600 receives an alternative one of the gradation voltages V1~V*n* set by the resistor string 800 through a selected buffer corresponding to such voltage. The driven buffer transfers the selected gradation voltage to the DAC 500. For instance, if the first buffer control signal CS1 is enabled, the first buffer 611 is activated to transfer the first gradation voltage V1 to the DAC 500 as the output signal GV1. If the second buffer control signal CS2 is enabled, the second buffer 612 is activated to transfer the second gradation voltage V2 to the DAC 500 as the output signal GV2.

Then, the DAC 500 selects the gradation voltage provided from the output buffer 600 and applies the current gradation voltage to the LCD panel 900, in response to the output signals LS1~LS*k* supplied from the level shifter 200.

The aforementioned procedures from the register block 100 to the DAC 500, are repeatedly carried out until all of the gradation voltages as tone information for a frame are applied into the LCD panel, as regulated by the output buffer control circuit 700.

At this time, when there is no coincidence between the buffer address signals and the R/G/B data signals in the comparing unit 720, the control signal does not emanate from any one of the comparators in the comparing unit 720. During a display operation for a frame, a buffer assigned to undesired tone information is prevented from being activated to transfer the tone information (i.e., the gradation voltage) to the LCD panel. This reduces the rate of power consumption over a conventional LCD device because unnecessary generations of the buffer control signals are prohibited therefrom to turn the output buffer off.

As described above, the invention offers advantages in reducing power consumption in a LCD device with a source driver, in which output buffers are arranged in smaller numbers relative to the conventional device. The number of buffers in an output buffer corresponds to the number of gradation voltage levels, and not to the number of pixel channels which is usually larger than the number of gradation voltage levels. Moreover, since a selected one of the plurality of buffers is activated in correspondence with a desired gradation voltage level as current tone information, unnecessary power consumption does not occur.

Although the preferred embodiments of the present invention have been disclosed for illustrative purposes, those skilled in the art will appreciate that various modifications, additions and substitutions are possible, without departing from the scope and spirit of the invention-as described in the accompanying claims.

What is claimed is:

1. A source driver of a liquid crystal display device, the source driver comprising:

a register block for storing digital data signals associated with tone information;

a level shifter for converting voltage levels of the digital data signals into predetermined voltage levels;

an output buffer controller for generating a plurality of buffer control signals in response to the digital data signals;

a resistor string for establishing a plurality of gradation voltages with analog constituent;

an output buffer for transferring the gradation voltages in response to the buffer control signals; and a digital-to-analog converter for providing the gradation voltages transferred from the output buffer into a liquid crystal display panel in response to output signals supplied from the level shifter.

2. The source driver of claim 1, wherein the output buffer comprises a plurality of buffer units each of which provides an alternative one of the gradation voltages to the digital-to-analog converter.

3. The source driver of claim 2, wherein the output buffer controller comprises:

a buffer address storage unit for storing a plurality of address signals to respectively designate the buffer units of the output buffer;

a comparison unit for comparing the digital data signals with output signals of the buffer address storage unit; and a control signal generating unit for generating the buffer control signals to operate the buffer units of the output buffer in response to output signals from the comparison unit.

4. The source driver of claim 3, wherein the buffer address storage unit comprises a plurality of storage units each of which stores one of the address signals for the buffer units.

5. The source driver of claim 4, wherein the comparison unit comprises a plurality of comparators which generate control signals after comparing the digital data signals with the address signals.

6. The source driver of claim 5, wherein the control signal generating unit comprises a plurality of generators which output buffer control signals to operate the buffer units of the output buffer.

7. A source driver of a liquid crystal display device, the source driver comprising:

a shift register for generating a plurality of enable signals in sequence;

a sampling register for storing a plurality of R/G/B data signals at their corresponding pixels in response to the enable signals;

a hold register for storing the R/G/B data signals supplied through the sampling register;

a level shifter for converting voltage levels of the R/G/B data signals of the hold register into predetermined voltage levels;

an output buffer controller for generating a plurality of buffer control signals in response to the R/G/B data signals;

a resistor string for establishing a plurality of gradation voltages with analog constituent;

an output buffer for transferring the gradation voltages in response to the buffer control signals; and a digital-to-analog converter for providing the gradation voltages transferred from the output buffer into a liquid crystal display panel in response to output signals supplied from the level shifter.

8. The source driver of claim 7, wherein the output buffer comprises a plurality of buffer units each of which provides an alternative one of the gradation voltages to the digital-to-analog converter.

9. The source driver of claim 8, wherein the output buffer controller comprises:

a buffer address storage unit for storing a plurality of address signals to respectively designate the buffer units of the output buffer;

a comparison unit for comparing the R/G/B data signals with output signals of the buffer address storage unit; and a control signal generating unit for generating the buffer control signals to operate the buffer units of the output buffer in response to output signals from the comparison unit.

10. The source driver of claim 9, wherein the buffer address storage unit comprises a plurality of storage units each of which stores one of the address signals for the buffer units.

11. The source driver of claim 10, wherein the comparison unit comprises a plurality of comparators which generate control signals after comparing the R/G/B data signals with the address signals.

12. The source driver of claim 11, wherein the control signal generating unit comprises a plurality of generators which output buffer control signals to operate the buffer units of the output buffer.

13. A method of driving a liquid crystal display device having a plurality of buffer units and a liquid crystal display panel, the method comprising the steps of:

generating a digital data signal as tone information;

level-shifting the digital data signal;

comparing the digital data signal with an address signal assigned to one of the plurality of buffer units;

generating a plurality of buffer control signals for enabling the buffer units in response to a result of the comparison;

loading an alternative one of a plurality of gradation voltages into the buffer unit assigned to the alternative gradation voltage in accordance with the plurality of buffer control signals; and providing the alternative gradation voltage to the liquid crystal display panel in response to the level-shifted signal.

14. The method as recited in claim 13, wherein the number of buffer units which is controlled by the plurality of buffer control signals matches a number of gradation voltages.

15. The method as recited claim 14, wherein an alternative one among the plurality of buffer units is activated in response to a current gradation voltage level.

16. A method of driving a liquid crystal display device having a plurality of buffer units and a liquid crystal display panel, the method comprising the steps of:

generating a plurality of enable signals in sequence;

storing address signals to respectively designate the plurality of buffer units;

generating a plurality of gradation voltages;

receiving R/G/B data signals from the external and storing the R/G/B data signals in their corresponding pixels in response to the enable signals;

level-shifting voltage levels of the R/G/B data signals to predetermined voltage levels;

generating control signals after comparing the R/G/B data signals with the address signals;

generating a plurality of buffer control signals for operating the plurality of buffer units in response to the control signals;

loading an alternative one of the plurality of gradation voltages into an conductive buffer unit assigned to the alternative gradation voltage; and providing the alternative gradation voltage to the liquid crystal display panel in response to the level-shifted signal.

17. The method as recited in claim 16, wherein the number of buffer units which is controlled by the plurality of buffer control signals matches a number of gradation voltages.

18. The method as recited in claim 17, wherein an alternative one among the plurality of buffer units is activated in response to a current gradation voltage level.

* * * * *